United States Patent [19]

Perry

[11] 4,282,855

[45] Aug. 11, 1981

[54] FIREPLACE SCREEN SYSTEM

[76] Inventor: Charles Perry, 6166 Parkwood Rd., Mentor, Ohio 44060

[21] Appl. No.: 42,127

[22] Filed: May 24, 1979

[51] Int. Cl.[3] ..... F24J 3/02

[52] U.S. Cl. ..... 126/121; 126/138; 126/140

[58] Field of Search ..... 126/121, 138, 139, 140, 126/142, 146, 193, 198, 200, 143

[56] References Cited

U.S. PATENT DOCUMENTS

| | | | |
|---|---|---|---|
| 2,398,240 | 4/1946 | Merryweather et al. | 126/140 |
| 2,747,568 | 5/1956 | Dupler | 126/140 X |
| 3,368,545 | 2/1968 | Ibbitson | 126/140 X |
| 3,372,689 | 3/1968 | Goudy | 126/140 |
| 3,452,737 | 7/1969 | Pellegrino et al. | 126/121 |
| 3,459,173 | 8/1969 | Lydle | 126/138 X |
| 4,041,930 | 8/1977 | Katona | 126/198 |
| 4,197,829 | 4/1980 | Pierce | 126/140 X |

*Primary Examiner*—James C. Yeung
*Assistant Examiner*—Larry Jones
*Attorney, Agent, or Firm*—Watts, Hoffmann, Fisher & Heinke Co.

[57] ABSTRACT

The invention relates to a fireplace screen system which includes a single and/or multi-section fireplace screen made of one or more glass panels which are laterally spaced apart to provide a heat and insulation barrier construction. An air blower assembly communicates with the interior space between the panels for circulating air heated by the fireplace into the surrounding room area to be heated such that the system provides a heat barrier and insulation when the fireplace is not in use and provides a heat transfer structure when the fireplace is in use.

4 Claims, 5 Drawing Figures

FIREPLACE SCREEN SYSTEM

BACKGROUND OF THE INVENTION

The present invention relates generally to shields or screens for fireplaces and more specifically relates to a new and novel construction for a fireplace screen which effectively provides a heat barrier and insulation when the fireplace is not in use and which provides an efficient heat transfer system for conveying heated air to the surrounding area to be heated during normal use of the fireplace. The invention has particular appplication in fireplaces such as masonry fireplaces and any type of pre-fabricated fireplace construction having an opening which can be spanned with a fireplace screen.

With the advent of energy and fuel shortages there is a contant need to develop energy conservation devices particularly in respect to maximizing heat efficiencies by reason of the current fuel shortages. Accordingly, by reason of the shortages of fossil fuels many persons, such as residential home owners, have sought to obtain greater efficiency in utilization of the conventional fireplace for heating purposes.

Heretofore, there have been many efforts undertaken in respect to making utilization of the fireplace for heating purposes more efficient. One such method has been to improve the construction and quality of the material comprising conventional type glass for fireplace screens. Another method which is currently popular has been to utilize a hollow grate-like unit with or without a blower motor for circulating heated air from the fireplace into the adjacent room area to be heated, for example. These prior methods, however, have not been completely satisfactory in achieving all of the characteristics for maximum energy (heat) conservation. For example, conventional glass fireplace screens of single or multi-panel construction provide merely a protective barrier when the fireplace unit is in use to prevent accidental fires and/or an insulation barrier when the fireplace unit is not in use. The grate-like units presently on the market provide no heat insulation barrier when the fireplace is not in use nor any protection against accidental fires when the fireplace is in use. Accordingly, such prior devices and methods do not provide all of the combined advantages which are achieved in the present invention. Examples of prior fireplace screen systems include those shown in the following U.S. Pat. Nos. 2,747,568; 3,368,545; 3,452,737 and 4,058,107.

SUMMARY OF THE INVENTION

The present invention relates to a new and novel construction for a fireplace screen system adapted for use with any conventional type fireplace. The system of the invention comprises one or more glass fireplace sections each of which is comprised by a pair of operably disposed glass panels which are laterally spaced apart a distance sufficient to provide a heat barrier and insulation chamber therebetween.

In the invention, the glass panels are operably connected adjacent lower ends by an inlet manifold assembly which includes a selectively adjustable gate system which can be controlled for opening and/or closing the combustion air holes for controlling ingress of external air into the fireplace hearth and for closing the system when the fireplace is not in use. At their upper ends the glass panels are provided with a baffle assembly for directing heated internal air outwardly into the area to be heated.

Further objects and advantages of the invention will become apparent as the following description proceeds in conjunction with the drawings and claims hereof.

DESCRIPTION OF THE PREFERRED EMBODIMENTS

Figure 1:
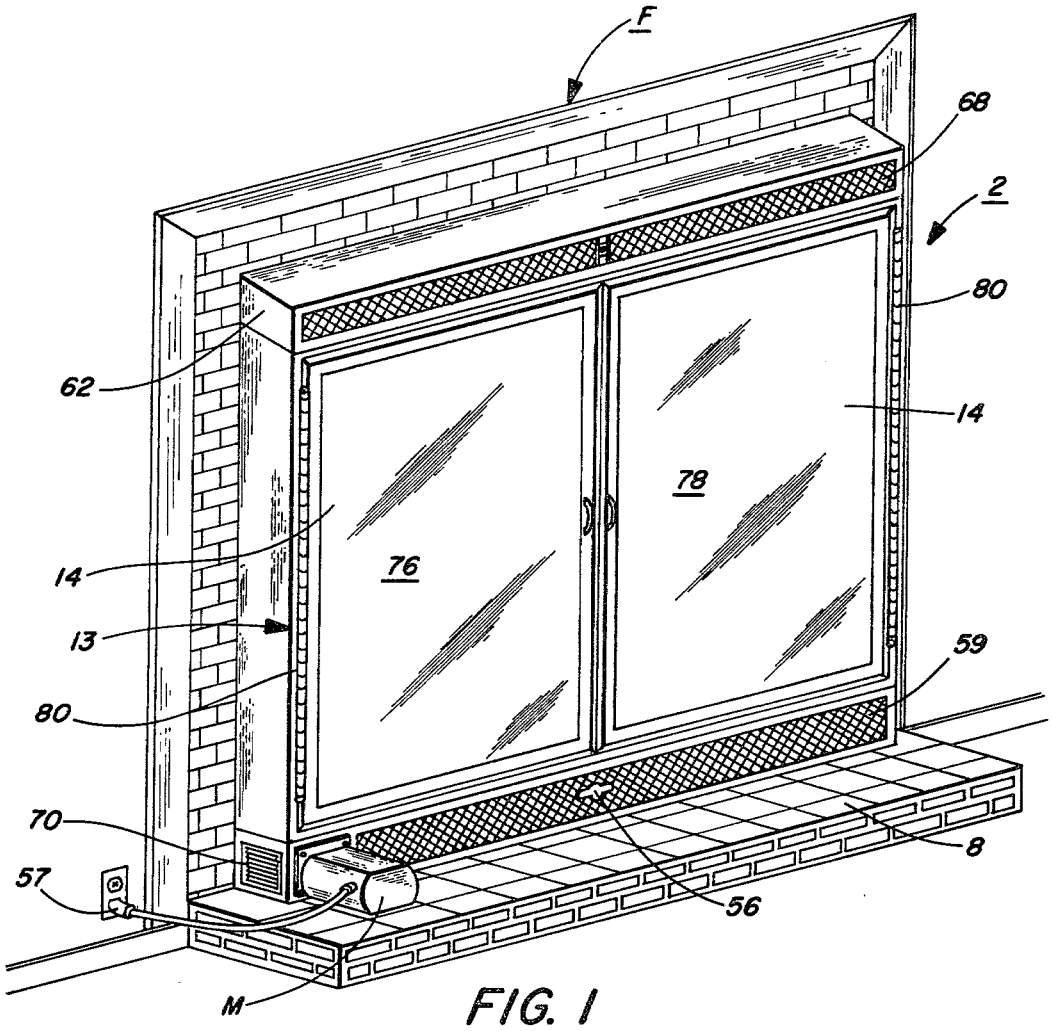
FIG. 1 is a generally perspective view illustrating one form of the fireplace screen of the invention made utilizing two glass panel sections.
Figure 2:
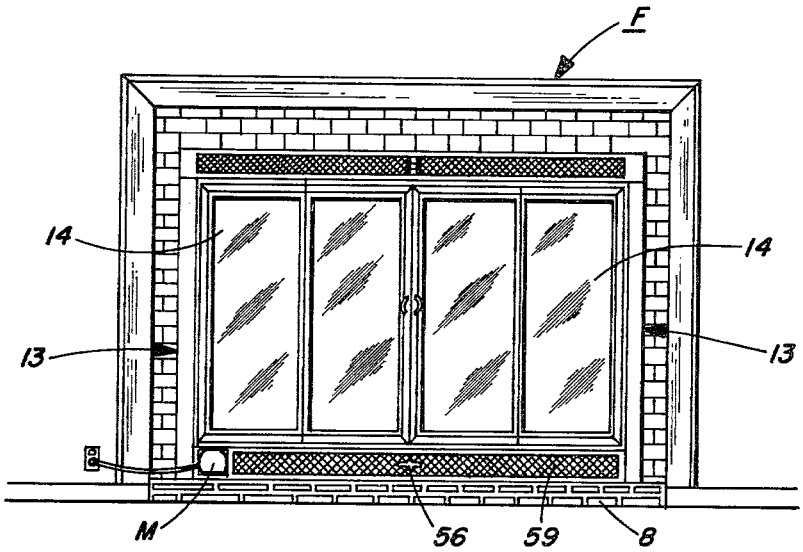
FIG. 2 is a front elevation view illustrating another embodiment of the invention wherein four glass panel sections are employed which are hinged together in accordance with the concept of the present invention.

Referring now again to the drawings and in particular to FIG. 1 thereof, there is illustrated a fireplace screen, that is shown generally at 2, made in accordance with the invention adapted for mounting in a conventional type fireplace system, designated generally at F, of the type which employs a conventional fireplace opening 4, (FIG. 3), as known in the art. The fireplace incorporates a conventional manually adjustable damper system 6 for opening and closing the opening 4 in relation to the chimney (not shown) as known in the art. The fireplace hearth 8 provides a floor for supporting the fireplace screen 2 of the invention and a conventional type log-grate for holding logs to be burnt, designated generally at 10, in accordance with the invention.

As will be seen, the fireplace screen 2 provides generally a rigid structure which rests on the hearth 8 to provide an effective heat barrier and insulation seal for the fireplace as well as a decorative piece of fireplace equipment. Accordingly, it will be understood that the fireplace screen can be made in two sections (doors) four sections or even as a single unitary construction, as desired. Now in accordance with the invention and with reference to FIG. 3 thereof, the fireplace screen 2 includes a pair of laterally spaced oppositely disposed glass panels 12 and 14 which extend parallel to one another and generally at right angles to the hearth 8. Preferably, the panels 12 and 14 are laterally spaced by a distance of approximately $2\frac{3}{8}$ inches to provide a chamber 15. The plates 12 and 14 are preferably made of a glass composition having good heat insulation and heat transfer characteristics preferably commercially available under the trade name tempered glass. Preferably each of the plates 12 and 14 has a thickness of approximately 3/16 inches and a heat transfer characteristic of maximum air pressure/glass temp reduction/air discharge increase value.

In the invention, it is important that the glass panels 12 and 14 have the aforementioned heat transfer characteristics for transferring heated air to the area to be heated during normal use of the fireplace. Preferably, the inner glass panel 12 has a greater heat transfer characteristic as compared to the outer glass panel 14 such that the inner panel 12 acts as a transfer barrier, whereas the outer panel 14 acts as an insulation barrier when the fireplace is not in use.

In the invention, the glass panels 12 and 14 are hinged at their sides to side frame members 13 and are supported at their lower ends, as at 16 and 18 (FIG. 5) on a manifold unit, designated generally at 20, which, in turn, rests on the hearth 8. The panels 12 and 14 rest on a manifold box 22 (FIG. 5) and are held together in laterally spaced apart relationship via the support plates 24 and 60 having a pair of integral upstanding flanges 26 which act to hold and center the glass panels 12 and 14 in relation to the support plates 24 and 60. The manifold box 22 is of a polygonal, such as of a square, configuration defined by a bottom wall 25, side walls 27, top walls 29 and end walls 31 (FIG. 5) which are interconnected to provide the structure as shown. The upper wall 29 has a series of outlet openings 28 which correspond with concentrically oriented outlet openings 30 provided in the support plate 24 to enable the flow of heated air from the fireplace outwardly and generally vertically upwardly between the glass panels 12 and 14 as illustrated by the arrows designated generally at 32, in FIG. 3.

Figure 4:
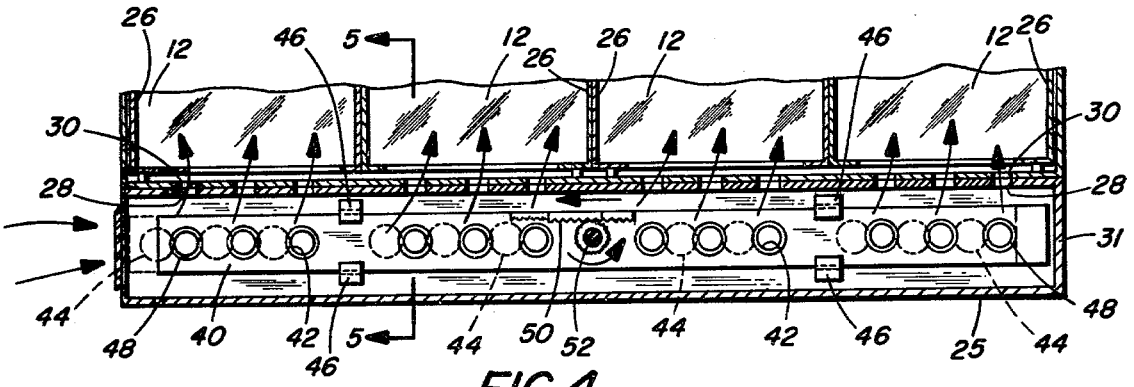
FIG. 4 is a fragmentary, vertical section view taken along the line 4—4 of FIG. 3 and on an enlarged scale.
Figure 5:
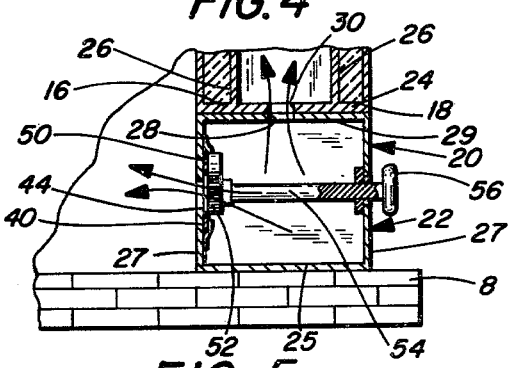
FIG. 5 is a fragmentary, vertical section view taken along the line 5—5 of FIG. 4 and on an enlarged scale in respect thereto.

As best seen in FIGS. 4 and 5, the manifold is provided with a selectively operable mechanism for opening and closing ingress and egress to the interior of the fireplace opening 4 and the chamber 15. As shown, this mechanism includes a horizontally reciprocal slide plate 40 of a generally rectangular construction which is of a length so as to be co-extensive substantially in length with that of the manifold box 22. This plate 40 is divided with a series of laterally spaced generally circular openings, as at 42, which are adapted to selectively communicate with openings 44 provided in the side walls 26 of the manifold box 22, as at 44. In the form shown, the plate 40 is mounted by a series of guide members, as at 46, which are integrally attached, as by weldments, to the side walls 26 of the manifold box 22.

To provide lateral shifting movement of the plate 40 a cam track 50 is integrally attached to the plate 40 in the form of a rack which is engaged by a cam member 52 which is fixedly attached to a shaft 54 which is rotatably operated by a control knob 56, as best illustrated in FIGS. 1 and 5. Accordingly, upon rotation of the knob 56, the shaft 54 rotates, for example, in a counter-clockwise direction (FIG. 4) for shifting the slide plate 40 to the left (FIG. 4) for opening and closing the openings provided in the inner side wall 27 (FIG. 5) of the manifold box 22 so as to provide ingress of air from the outside of the fireplace to within the interior of the fireplace and so as to provide a minimum of ambient air creating a forced air combustion situation proven safe and effective in the present invention.

Figure 3:
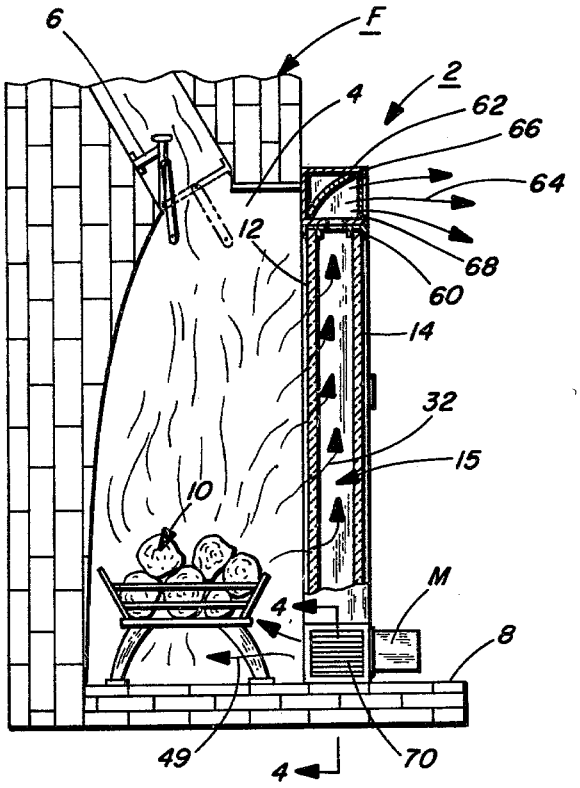
FIG. 3 is a fragmentary, vertical section view illustrating the fireplace screen of the present invention.

The result of this theory provides maximum combustion temperatures in which heat transfer through the tempered glass panes, along with the forced air between the panes therewith, creates the necessary volume of air pressure which provides a maximum glass to glass temperature reduction, with a maximum increase in discharge air temperature as illustrated by the arrows, as at 32 and 64, in FIG. 3.

As best seen in FIG. 4, opening and closing of the openings 44 is illustrated in dotted line, whereas, the open position of the openings is illustrated in solid line, as at 48. Accordingly, actuation of the knob 56 functions to reciprocate the plate 40 so as to open and close ingress from the interior of the fireplace to the manifold box 22. When the motor, as at M, is operative external air can be blown into the chamber 15 and the fireplace as shown by the arrows 49 as in FIG. 3. When the motor is not in operation the system can be closed to external ambiant air from the room to be heated by actuation of knob 56.

As shown, the motor M may be conveniently attached to one end of the manifold box 22 (FIG. 3) so as to transfer ambiant external air into the system and may be attached to a suitable electrical wall plug, as at 57 as best illustrated in FIG. 1. The front wall 27 of the manifold box may be provided with a decorative surface, as at 59, to match the upper grid 68, as desired.

In the invention, the glass panels 12 and 14 are connected and held apart at their upper end in spaced relation by a top plate 60 with one inch round apertures laterally spaced. An upper polygonal (square) manifold member 62 (FIG. 3) directs heated air outwardly into the area to be heated, as illustrated by the arrows at 64. The manifold member 62 includes an internal curved baffle plate 66 which directs heated air out to a wire mesh grid 68 as best seen in FIG. 1. Accordingly, it is preferred that the upper manifold member 62 extend across the full length of the fireplace screen and is of a size generally corresponding to that of the lower manifold member 20.

As best illustrated in FIG. 1, the fireplace screen may be provided with an inlet vent 70 in the end wall 31 which enables air to be drawn in and forced into the fireplace via the motor M. Preferably, this vent is disposed adjacent the motor M and at right angles thereto for maximum efficiency.

In the invention, the glass panels 12 and 14 together define individual doors 76 and 78 (FIG. 1) which may be hinged, as at 80 by a piano-hinge to the side frame members 13 which provide a housing for the glass panel arrangement.

From the foregoing description and accompanying drawings, it will be seen that the present invention provides an improved fireplace screen structure for fireplaces, including a new construction and arrangement of a dual glass panel construction which enables heated air to be forced upwardly between the panels whereby it may be passed by a ventilating mesh or grid outwardly into the room to be heated. As one could understand from the foregoing description, this fireplace invention was designed purposely for ambient room air, which generally in most cases will be relatively cooler at floor level, to be forced into and between the tempered glass panels.

In order to increase the temperature of this cooler forced air, the double glass enclosure must have the capability to create a certain amount of volumetric air velocity. In my observations and testing of this invention, I have found that using a 130 cubic/feet/per/minute (CFM) blower/motor arrangement, with the speed of such motor being 1,500 RPM, and at 0.25 running amperage provided an economical, but sufficient means to deliver the forced air for necessary operation of the invention.

In further calculation, I found that 179 cubic inches is the total volumetric area of one defined chamber of the two glass panels. Multiplying this figure two times revealed 358 cubic inches total for the proto-type size I designed. This figure, of course, would change with 2 or 3 different total size units. I believe, that in testing the proto-type I have built, the actual Cubic/Feet/Minute of forced air between the glass panes is irrelevant to 2 or 3 different sized fireplace screen which may be used.

I feel the most important aspect of this invention is the fact that the heat source (fire) is so close to the total square foot surface of the inner glass panel, and for this fact the heat transfer through the inner glass panel, with the outer glass panel acting as a semi-barrier to this heat transfer, is at it's maximum causing the molecules of the forced air between the glass panels to be in a state of rapid motion.

The specific weight of this heated air would decrease to less than 0.24 Btu/lb., this being the specific heat of air. To put this simply, the higher the temperature of air, the lighter it becomes and the more freely it will move. Accordingly, pertaining to my invention, the actual Cubic/Feet/Per/Minute of forced air input may increase by 15 to 30 CFM depending on the intensity of the fire, which is an advantage to the overall performance of my invention.

I claim:

1. In a forced air fireplace screen system comprising, at least one panel section adapted to be mounted on a fireplace opening including a pair of neatly parallel and laterally spaced oppositely disposed tempered glass panels, said tempered glass panels being connected together by oppositely disposed side frames to define a chamber for permitting heat extraction by means of forced air therebetween, baffle means disposed at the top of said section for directing heated air upwardly and outwardly from between said glass panels, inlet and manifold means disposed adjacent the bottom of said section for the delivery of external ambient air between said glass panels, and electric blower motor means adjacent said inlet and manifold means communicating with the chamber defined by said glass panels for forcing ambient air upwardly through said chamber and outwardly through said baffle means, said manifold means being an elongated box-like construction defined by oppositely disposed side and end walls defining a generally rectangular configuration in side elevation, one of said end walls including a vent member defining said inlet means, one of said side walls containing, (the innermost wall of said manifold), a plurality of laterally spaced apertures, a slide bar operably connected to said side wall including said selectively adjustable control means for reciprocating said slide bar in relation to said apertures for selectively opening and closing said apertures for controlling the minimum amount of combustion air delivered into the fireplace for proper combustion with the remaining greater volume of air delivered into said chamber so as to confine and control the heat of radiation created by the fireplace.

2. In a forced air fireplace screen system comprising, two separate panel sections containing a pair of parallel and laterally spaced oppositely disposed tempered glass panels, said tempered glass panels being connected together and held in relationship apart by oppositely disposed vertical side flanges, bottom horizontal support plate, and top horizontal support plate to define two separate chambers for permitting heat extraction by means of forced air therebetween; said vertical side flanges having an inner track and outer track to hold said tempered glass panels vertically upright between vertical side flanges, said bottom horizontal support plate having a series of openings for the passage of forced air into said separate chambers; and, said top horizontal support plate having a series of openings for the exit of forced air from said separate chambers, said separate chambers being connected to left and right vertical side members by means of a continuous piano-like hinge, baffle means disposed at the top of said left and right chamber for directing heated air upwardly and outwardly from between said glass panels, and inlet and manifold means disposed adjacent the bottom of said left and right chambers having a series of circular openings (in the uppermost wall of said manifold) to correspond with concentrically oriented circular openings in said bottom horizontal support plates, and electric blower motors means adjacent said inlet and manifold means for forcing ambient air upwardly through said openings in upper wall of said manifold and said openings in said bottom horizontal support plates of said left and right chambers, said forced air being heated and pressurized within said chambers, exiting said chambers through circular openings in said top horizontal support plates, and outwardly through said baffle means into the room and adjacent rooms to be heated, said baffle means and said inlet and manifold means connected to said left and right vertical slide members at about 90 degree angles by respective fastening means.

3. In a fireplace screen system in accordance with claim 2, wherein said manifold means comprising holes facing the fire-interior of fireplace and said electric motor blower forcing a minimum amount of ambient air into burning fire for proper combustion.

4. In a fireplace screen system in accordance with claim 2, wherein said manifold means being an elongated box-like construction defined by oppositely disposed side and end walls defining a generally rectangular configuration in side elevation, one of said end walls including a vent member defining said inlet means one of said side walls containing, (the innermost wall of said manifold), a plurality of laterally spaced apertures, a slide bar operably connected to said side wall including said selectively adjustable control means for reciprocating said slide bar in relation to said apertures for selectively opening and closing said apertures for controlling the minimum amount of forced air delivered into the foreplace for proper combustion with the remaining greater volume of forced air delivered into said left and right chambers so as to maximize the extraction of sensible heat from the fire, and control the heat of radiation created by the fireplace.

* * * * *

UNITED STATES PATENT AND TRADEMARK OFFICE

CERTIFICATE OF CORRECTION

PATENT NO. : 4,282,855

DATED : August 11, 1981

INVENTOR(S) : Charles Perry

It is certified that error appears in the above-identified patent and that said Letters Patent are hereby corrected as shown below:

Column 1, line 18, "a contant need" should be -- a constant need --.

Column 3, line 34, "26" should be -- 27 --;
line 38, "26" should be -- 27 --.

Column 4, line 4, "ambiant" should be -- ambient --;
line 8, "ambiant" should be -- ambient --.

Column 6, line 51, "foreplace" should be -- fireplace --.

Signed and Sealed this

*Second* Day of *February 1982*

[SEAL]

*Attest:*

GERALD J. MOSSINGHOFF

*Attesting Officer*

*Commissioner of Patents and Trademarks*